United States Patent [19]

Lewis

[11] 3,939,480

[45] Feb. 17, 1976

[54] LEVEL AND CROSS-LEVEL STABILIZATION TECHNIQUE FOR SEARCH RADAR ANTENNAS

[75] Inventor: Bernard L. Lewis, Oxon Hill, Md.

[73] Assignee: The United States of America as represented by the Secretary of the Navy, Washington, D.C.

[22] Filed: Sept. 17, 1974

[21] Appl. No.: 506,927

[52] U.S. Cl. ..... 343/761; 343/765; 343/781; 343/840

[51] Int. Cl.[2] ..... H01Q 3/12

[58] Field of Search ..... 343/761, 839, 840, 765, 343/781

[56] References Cited

UNITED STATES PATENTS

| | | | |
|---|---|---|---|
| 2,976,533 | 3/1961 | Salisbury | 343/761 |
| 3,386,100 | 5/1968 | Jaszberenyi | 343/839 |
| 3,534,373 | 10/1970 | Gustincic et al. | 343/761 |
| 3,641,577 | 2/1972 | Tocquec | 343/839 |

*Primary Examiner*—Eli Lieberman
*Attorney, Agent, or Firm*—R. S. Sciascia; Arthur L. Branning; Norman Brown

[57] ABSTRACT

Rotation of a search radar antenna primary focusing structure about both the elevation and optical axes provides stabilization of the radiated beam in both level and cross-level respectively.

3 Claims, 4 Drawing Figures

LEVEL AND CROSS-LEVEL STABILIZATION TECHNIQUE FOR SEARCH RADAR ANTENNAS

BACKGROUND OF THE INVENTION

Search radar systems of the type considered here employ a rotating fan beam to locate targets in azimuth and elevation. In order to obtain maximum range and accuracy, it is important to stabilize the beam in its spacial orientation.

Radar antennas generally utilize a primary focusing structure which radiates energy onto a secondary focusing structure. The primary focusing structure defines the general beam-shape and acts as a source of energy illuminating the secondary focusing structure. The secondary focusing structure in turn collimates the incident energy and forms a beam which is an image of the source at infinity.

The primary focusing structure is generally small and lightweight. In contrast, the secondary focusing structure typically is rather large and massive.

Search radar antennas are often placed on a moveable vehicle such as an airplane, ship or ground vehicle. The vehicle will generally be non-stationary, and in general will be given to roll, pitch, and yaw. This motion must be compensated for in order to stabilize the beam.

Prior methods of stabilization involved mounting of the entire antenna structure on a stabilized platform. Unfortunately, stabilization of large antennas in this manner not only adds undesirable additional weight to the carrying vehicle and requires a high-power system to manipulate the stabilizing platform, but results in poor antenna-stabilization bandwidth characteristics.

SUMMARY OF THE INVENTION

The present invention stabilizes a radar beam in both elevation and cross-level by rotating only the primary focusing structure of a radar antenna about its elevation and optical axes respectively.

A downward shift of the radar beam caused by antenna platform motion is compensated for by causing an upward angular displacement of the primary feed structure. Similarly, an angular shift of the radar beam about its optical axis is compensated for by causing an opposite angular displacement of the primary feed structure. In this way, the radar beam may be stabilized without moving the large secondary focusing structure.

OBJECTS OF THE INVENTION

It is an object of the present invention to stabilize the beam of a search radar antenna system without stabilization of the secondary focusing structure.

It is another object of the present invention to achieve a high stabilization bandwidth when stabilizing the beam of a search radar.

It is a further object of the present invention to stabilize the beam of a search radar antenna through utilization of only a small amount of power.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
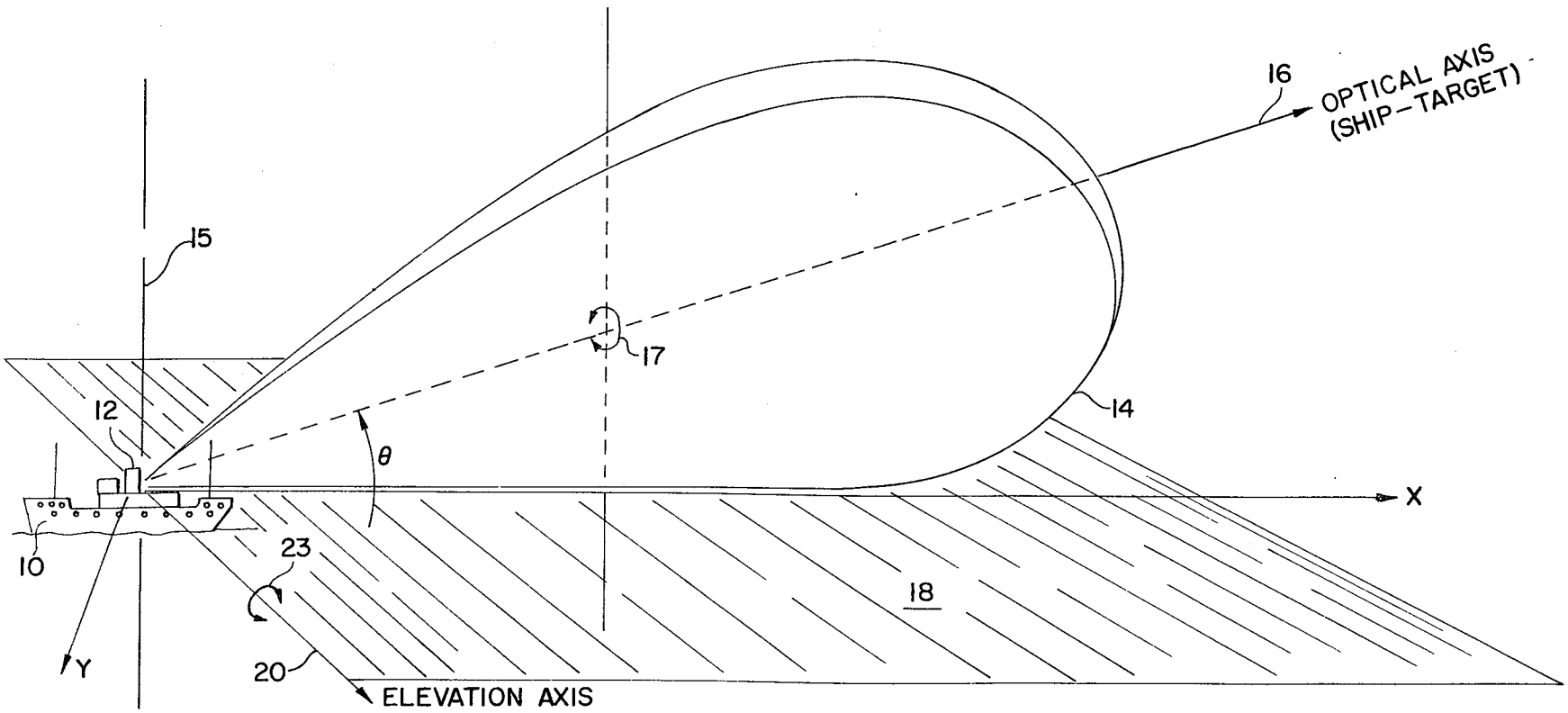
FIG. 1 depicts a typical beam pattern of a search radar.

FIG. 1 depicts a ship 10 carrying a search radar antenna 12. The radar antenna pattern generally consists of a fan-shaped beam 14 orientated in an essentially vertical plane. Beam 14 is rotated about a generally vertical axis 15 to form a scan in azimuth. Beam 14 generally assumes a fan-blade like shape having a cosecantsquared intensity distribution function.

Antenna 12 searches over a generally horizontal plane 18, defined by orthogonal X and Y axis intersecting at the center of antenna 12. An optical axis 16 is defined to pass from the center of the antenna through the maximum intensity point of the beam 14. Rotation (in the direction of arrows 17) about the optical axis 16 is termed cross-level. An elevation axis 20 perpendicular to the optical axis 16 is contained in horizontal plane 18. The angle formed between optical axis 16 and the horizontal plane 18 is termed elevation angle 0. Rotation (in the direction of arrows 23) about the elevation axis 20 is termed level.

It should be noted that the present invention may be used in conjunction with a wide range of specific primary and secondary focusing structures. For example, the secondary focusing structure may be a parabolic reflector, lens, or other suitable collimating means, while the primary focusing structure may be a simple feed horn, array of dipoles, or other radiating means used either without or in conjunction with a suitable subreflector element.

Figure 2:
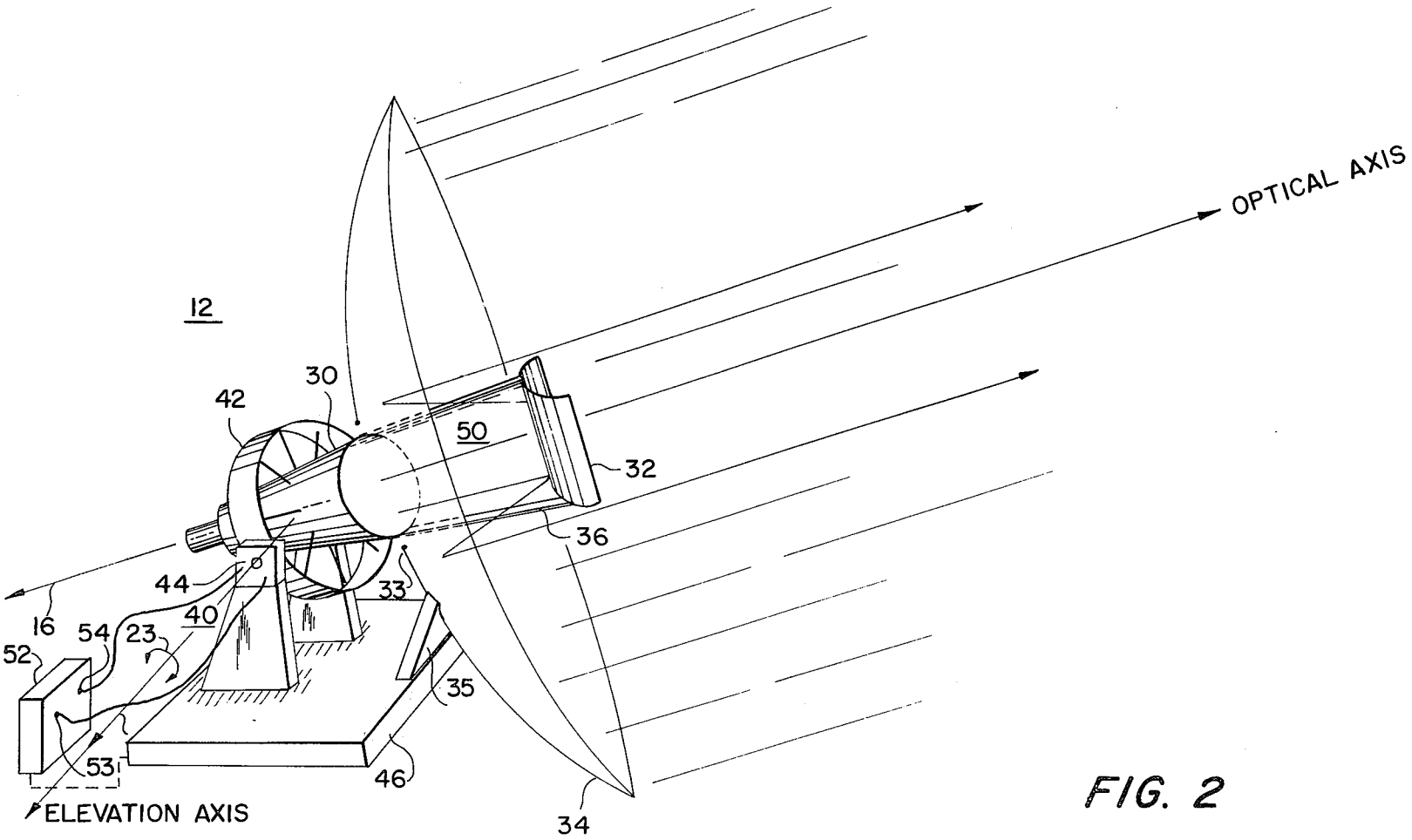
FIG. 2 depicts a search radar antenna system embodying the present invention.
Figure 3:
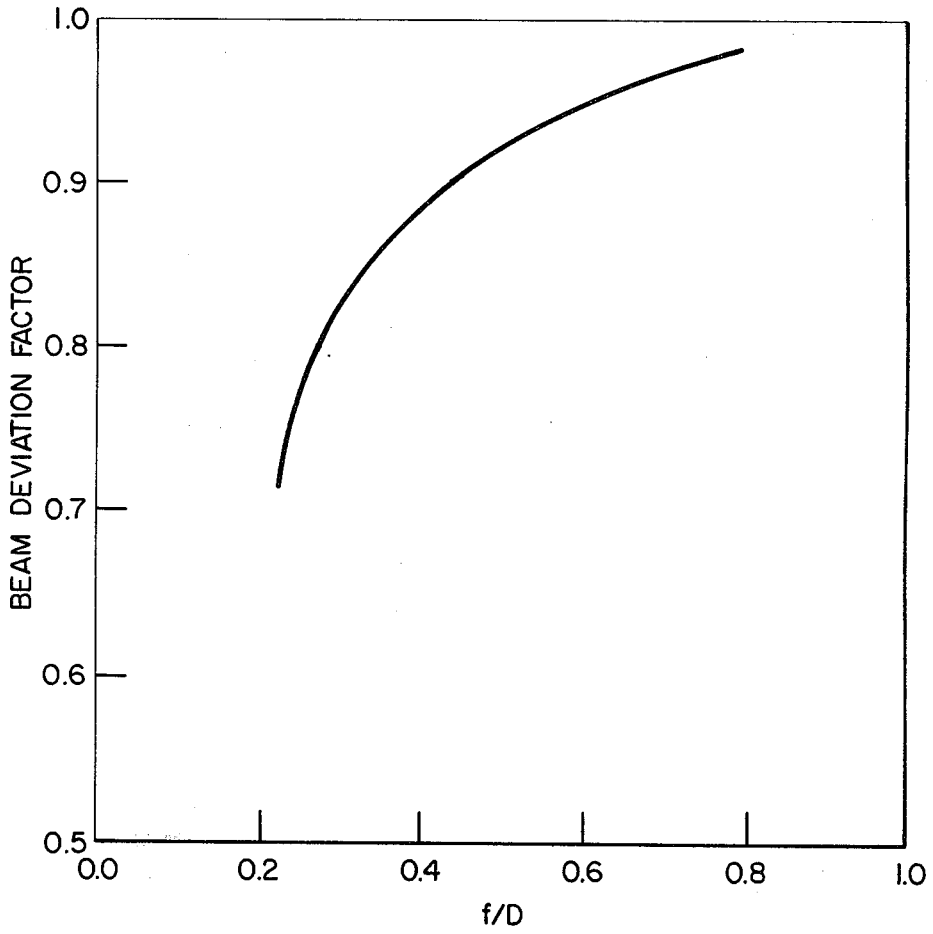
FIG. 3 is a graph showing the relationship between the Beam Deviation factor and the focal length-to-diameter ratio for a paraboloidal reflector.
Figure 4:
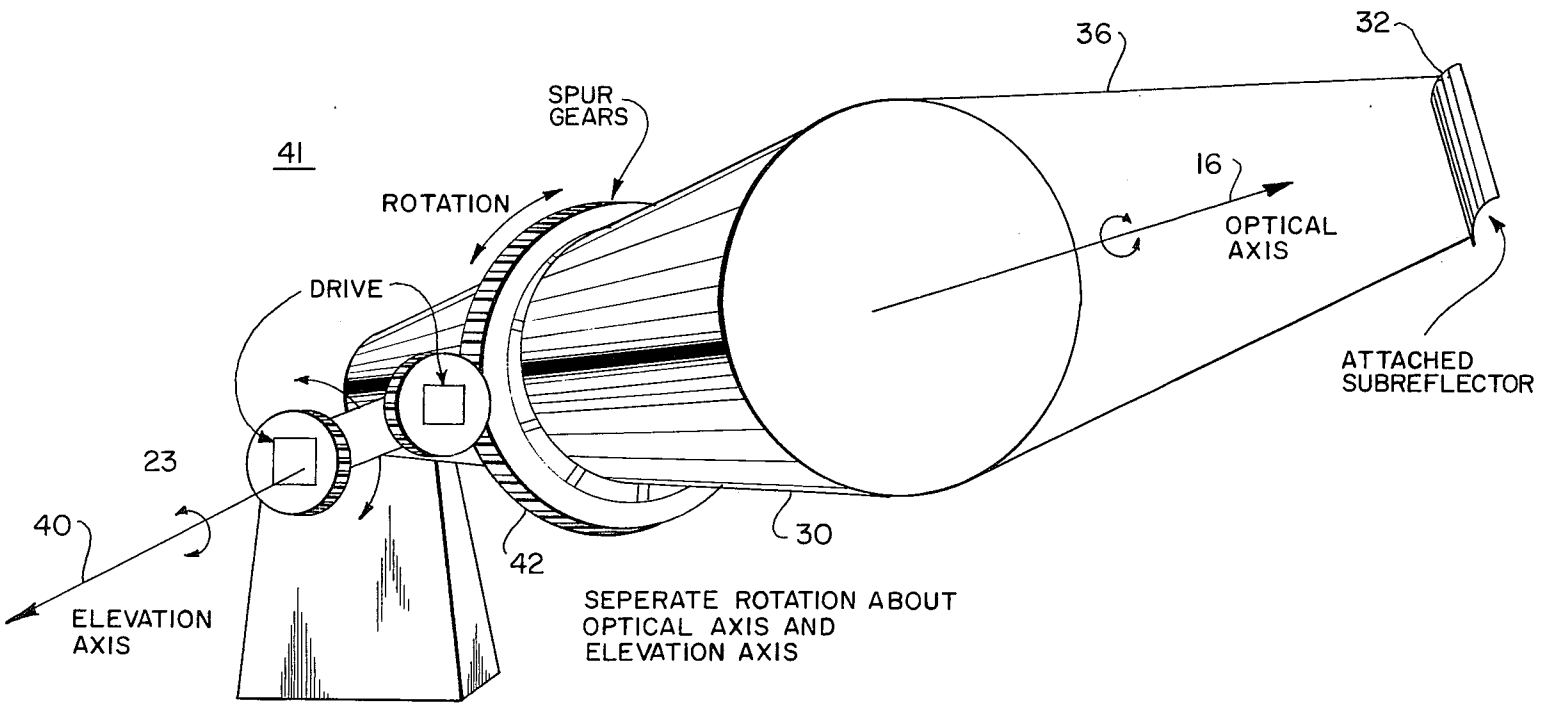
FIG. 4 illustrates in greater detail a mechanism for accomplishing independent rotation about the elevation and optical axis of the preferred embodiment.

One embodiment of the present invention is depicted in FIG. 2 and FIG. 3. Search radar antenna 12 has a feed horn 30 directed towards a subreflector 32 which in turn is directed towards a parabolic shaped main reflecting, or focusing element 34. In this embodiment of the present invention, feed horn 30 taken together with subreflector 32 form a primary feed structure 50, while main reflecting element 34 forms the secondary focusing strucuture.

Subreflector 32 is located at the focus of the main reflecting element 34 and is supported by rods 36 attached to feed horn 30. Main reflecting element 34 is supported by support members 35 attached to antenna support platform 46, and has an opening 33 at its center to accomodate the radiating end of feed horn 30 positioned there.

An orienting means 40 is comprised of a primary focusingstructure cross-level rotating assembly 42 and a primary focusingstructure elevation rotating assembly 44. Orienting means 40 supports the primary feed structure 50 and is itself attached to, and supported by, antenna support platform 46.

Basically, the mechanical orienting means 40 is in the nature of that found in a common backyard cement mixer, with the feed horn 30 and attached subreflector 32 in place of the mixing chamber. Cross-level orienting assembly 42 is like the mechanism that spins the mixing chamber (generally about axis 16), while elevation assembly 44 is like the mechanism that pivots the mixing chamber (about axis 40) to allow the cement to pour out. The rotation and pivoting motion is made with respect to the relatively fixed main reflector 34.

A particular mechanical implementation of spinning (rotation about axis 16) and pivoting (rotation about axis 40) of the described embodiment as depicted in FIG. 2 may be readily accomplished by one skilled in mechanical arts of this nature and will therefore not be further described.

A position-error sensor/controller 52 is adapted to sense motion of antenna support platform 46 and to provide signals to orienting means 40 indicating necessary corrective antenna position changes. Output terminal 53 of sensor/controller 52 provides an optical-axis 16 correction signal while output terminal 54 provides an elevation-axis 20 correction signal. These output terminals are respectively connected to cross-level elevation rotating assembly 42 and to elevation rotating assembly 44.

Motion of antenna platform 46 will generally cause antenna beam 14 to be directed away from its intended orientation. Beam 14 may thus be caused to shift from the desired elevation angle $\theta$ by an angular amount $\alpha$, and rotate by an angular amount $\gamma$ about its optical axis.

In operation, stabilization of the radar beam 14 is accomplished by orienting means 40 utilized in conjunction with position-error sensor/controller 52.

Controller 52 senses motion (with respect to an inertial reference system) of antenna support platform 46, attached antenna structure 12 and beam 14. The sensed motion is resolved by sensor/controller 52 into two signal components. The first component represents the direction and magnitude of angular displacement $\alpha$ of beam 14 about elevation axis 20. The second component represents the magnitude of angular displacement $\gamma$ of beam 14 about optical axis 16, but indicates the direction opposite to that actually encountered. These resolved component values are then respectively multiplied in controller 52 by a constant, termed the beam deviation factor. Multiplication by the beam deviation factor adjusts the magnitude of each component so as to provide an appropriate valued corrective signal to respective cross-level and elevation rotating assemblies 42 and 44 respectively.

Orienting means 40 then accomplishes stabilization of the antenna system 12 by rotating the primary focusing structure 50 about either or both the elevation axis 20 or the optical axis 16 by an amount directly proportional to the corrective signal received from sensor/-controller 52.

Motion of antenna platform 46 may cause the entire antenna assembly 12 to tilt upwards about the elevation axis 20 in a manner causing the beam 14 to shift upwards. To compensate for this upward shift, the subreflector-feed assembly must be tilted upwards (in the same direction) about the elevation axis 20. Also, platform 46 motion may cause the antenna 12 to rotate about the optical axis 16, resulting in the beam 14 being rotated. To compensate for this rotation, the primary focusing structure 50 must be rotated about the optical axis 16 in the opposite direction.

In this manner, stabilization of beam 14 is accomplished while the generally massive secondary focusing structure 34 is allowed to move in an uncontrolled manner with antenna platform 46.

The amount of rotation about a particular axis of the primary focusing structure 50 necessary to compensate for the motion of platform 46 is dependent only upon what is termed the beam deviation factor related to the secondary focusing structure 34. The beam deviation factor is considered with respect to the axis that the primary feed structure 50 is to be rotated about. The beam deviation factor is defined as the ratio of the angular shift of the beam 14 to the angular displacement of the primary focusing structure 50 (which provides the source of the beam 14). The beam deviation factor is a function of the geometry of the secondary focusing structure 34, and is discussed in various texts, including "Radar Handbook" (p. 10.10) by M. Sholnik, McGraw-Hill, 1970.

FIG. 3 depicts the beam deviation factor as a function of the focal length-to-diameter ratio ($f/D$) for the type of secondary focusing structure 34 utilized in the embodiment of the present invention.

Main reflecting element 34 has a typical shape comprising a section of a paraboloid having a larger width than height. In the present embodiment the focal length-to-width ($f/D_w$) ratio of the reflector 34 is 0.25, while the focal length-to-height ($f/D_h$) ratio is 0.75. This results in the beam deviation factor (determined from FIG. 3) in the horizontal plane having a value of 0.75 while the corresponding factor in the vertical plane is 0.97.

The effect of these beam deviation factors is that to compensate for motion of the beam in the vertical direction, each shift of 0.97° must be compensated for by a shifting of the primary focusing structure 50 of 1° in the vertical direction. On the other hand, rotation of the beam about the optical axis 16 typically results in an essentially horizontal shift, where each shift of 0.75° of the beam must be compensated for by a shifting of the primary focusing structure 50 by 1°.

The present invention allows position stabilization of a high frequency antenna, typically having a large and massive secondary focusing structure, by moving the relatively small primary focusing structure. In this manner improved stabilization bandwidth can be achieved, while stabilization of the antenna is accomplished with less energy required to move the smaller.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A motion stabilized high-frequency antenna system comprising;

an antenna platform;

a high frequency antenna having a primary focusing structure moveable about both elevation and optical axes of said antenna, and a secondary focusing structure rigidly mounted on said antenna platform wherein said primary focusing structure is comprised of a high frequency feedhorn directed at an attached subreflector, said feed horn and subreflector movable in unison with respect to said secondary focusing structure;

means for sensing the position of said secondary focusing structure with respect to a desired position and for generating rotating means positioning signals proportional to the elevation axis and optical axis components of the position difference between said sensed position and said desired position, said optical axis positioning signal indicating a direction of motion opposite to said sensed position difference, and said elevation axis positioning signal indicating the same direction of motion as said sensed position difference; and means connected to said sensing means for rotating said primary focusing structure separately and independently about said optical axis and said elevation axis of said antenna, whereby a change proportional to said sensed position difference as indicated by said positioning signals is produced in the position of said primary focusing structure.

2. The antenna system of claim 1 wherein said secondary focusing structure has a maximum vertical dimension and a maximum horizontal dimension, and wherein said signals corresponding to the optical axis and elevation axis respectively are proportional to the Beam Deviation Factor corresponding to said vertical and horizontal dimensions.

3. The antenna system of claim 2 wherein said primary focusing structure is comprised of a high frequency feed horn directed at an attached subreflector, and therein said secondary focusing structure is a parabolic reflector.

* * * * *